US005878822A

United States Patent [19]

Roy

[11] Patent Number: 5,878,822

[45] Date of Patent: Mar. 9, 1999

[54] TOOL WITH INTERCHANGEABLE HEADS

[76] Inventor: Willard G. Roy, 101 Cheek Dr., Dublin, Ga. 13021

[21] Appl. No.: 974,094

[22] Filed: Nov. 19, 1997

[51] Int. Cl.[6] ..... B25D 9/00

[52] U.S. Cl. ..... 173/90; 173/91; 173/132; 173/171; 403/377

[58] Field of Search ..... 173/90, 91, 132, 173/171; 81/177.5; 403/378, 377

[56] References Cited

U.S. PATENT DOCUMENTS

| | | | |
|---|---|---|---|
| 1,521,265 | 12/1924 | Anderson | 173/91 |
| 2,523,041 | 9/1950 | McKenzie | 403/377 |
| 2,980,456 | 4/1961 | McMullin | 403/378 |
| 2,989,968 | 6/1961 | Vogel | 403/378 |
| 3,036,482 | 5/1962 | Kenworthy et al. | 173/90 |
| 4,470,440 | 9/1984 | Thor | 173/90 |

*Primary Examiner*—Stephen F. Gerrity
*Assistant Examiner*—Steven Jensen

[57] ABSTRACT

A new tool with interchangeable heads for the selection of a proper tool for the digging or manipulating of a surface for landscaping or construction purposes. The inventive device includes a shaft and interchangeable head members insertable into the shaft including a first head member with an auger head section extending from a rod section, a second head member with an mallet head section extending from a rod section, and a third head member with a chisel head section extending from a rod section.

8 Claims, 2 Drawing Sheets

TOOL WITH INTERCHANGEABLE HEADS

BACKGROUND OF THE INVENTION

1. Field of the Invention

The present invention relates to landscaping tools and more particularly pertains to a new tool with interchangeable heads for the selection of a proper tool for the digging or manipulating of a surface for landscaping or construction purposes.

2. Description of the Prior Art

The use of landscaping tools is known in the prior art. More specifically, landscaping tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art landscaping tools include U. S. Pat. No. 5,085,281; U.S. Pat. No. 4,557,409; U.S. Pat. No. 4,971,479; U.S. Pat. No. 4,544,040; U.S. Pat. No. 4,261,424; and U.S. Pat. No. 356,475.

While these devices fulfill their respective, particular objectives and requirements, the aforementioned patents do not disclose a new tool with interchangeable heads. The inventive device includes a shaft and interchangeable head members insertable into the shaft including a first head member with an auger head section extending from a rod section, a second head member with an mallet head section extending from a rod section, and a third head member with a chisel head section extending from a rod section.

In these respects, the tool with interchangeable heads according to the present invention substantially departs from the conventional concepts and designs of the prior art, and in so doing provides an apparatus primarily developed for the purpose of the selection of a proper tool for the digging or manipulating of a surface for landscaping or construction purposes.

SUMMARY OF THE INVENTION

In view of the foregoing disadvantages inherent in the known types of landscaping tools now present in the prior art, the present invention provides a new tool with interchangeable heads construction wherein the same can be utilized for the selection of a proper tool for the digging or manipulating of a surface for landscaping or construction purposes.

The general purpose of the present invention, which will be described subsequently in greater detail, is to provide a new tool with interchangeable heads apparatus and method which has many of the advantages of the landscaping tools mentioned heretofore and many novel features that result in a new tool with interchangeable heads which is not anticipated, rendered obvious, suggested, or even implied by any of the prior art landscaping tools, either alone or in any combination thereof.

To attain this, the present invention generally comprises a shaft and interchangeable head members insertable into the shaft including a first head member with an auger head section extending from a rod section, a second head member with an mallet head section extending from a rod section, and a third head member with a chisel head section extending from a rod section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool with interchangeable heads apparatus and method which has many of the advantages of the landscaping tools mentioned heretofore and many novel features that result in a new tool with interchangeable heads which is not anticipated, rendered obvious, suggested, or even implied by any of the prior art landscaping tools, either alone or in any combination thereof.

It is another object of the present invention to provide a new tool with interchangeable heads, which may be easily and efficiently manufactured and marketed.

It is a further object of the present invention to provide a new tool with interchangeable heads, which is of a durable and reliable construction.

An even further object of the present invention is to provide a new tool with interchangeable heads which is susceptible of a low cost of manufacture with regard to both materials and labor, and which accordingly is then susceptible of low prices of sale to the consuming public, thereby making such tool with interchangeable heads economically available to the buying public.

Still yet another object of the present invention is to provide a new tool with interchangeable heads which provides in the apparatuses and methods of the prior art some of the advantages thereof, while simultaneously overcoming some of the disadvantages normally associated therewith.

Still another object of the present invention is to provide a new tool with interchangeable heads for the selection of a proper tool for the digging or manipulating of a surface for landscaping or construction purposes.

Yet another object of the present invention is to provide a new tool with interchangeable heads which includes a shaft and interchangeable head members insertable into the shaft including a first head member with an auger head section extending from a rod section, a second head member with an mallet head section extending from a rod section, and a third head member with a chisel head section extending from a rod section.

Still yet another object of the present invention is to provide a new tool with interchangeable heads that digs holes in a surface for planting seeds or installing fasteners.

Even still another object of the present invention is to provide a new tool with interchangeable heads that allows the user to select the proper tool in order to perform a variety of landscaping and construction duties.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
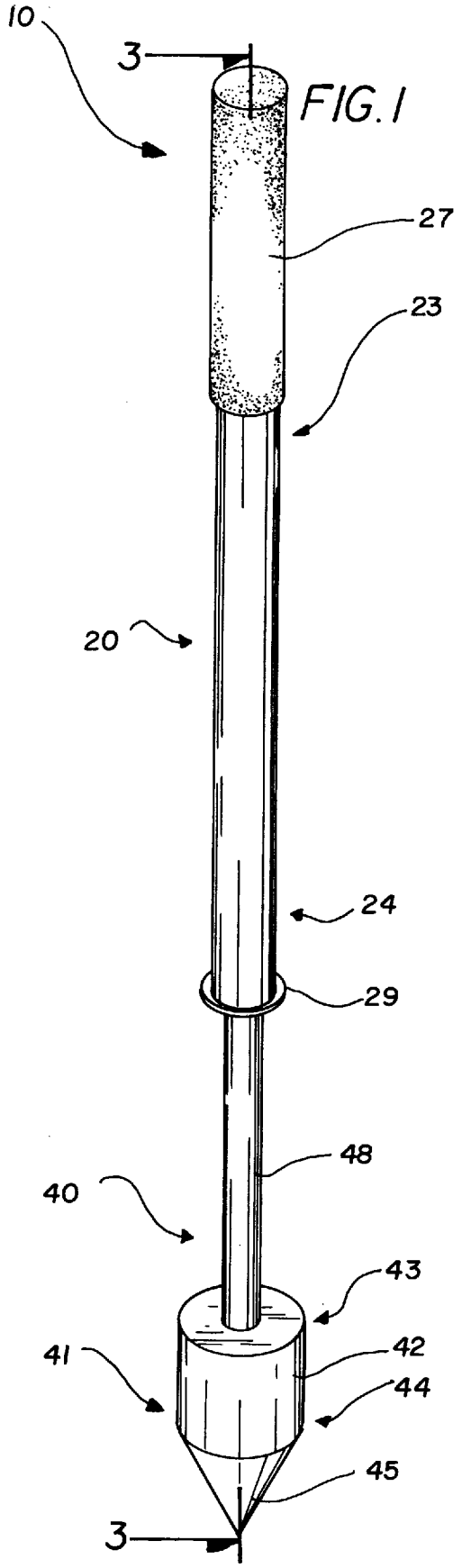
FIG. 1 is a perspective view of a new tool with interchangeable heads according to the present invention.

With reference now to the drawings, and in particular to FIGS. 1 through 5 thereof, a new tool with interchangeable heads embodying the principles and concepts of the present invention and generally designated by the reference numeral 10 will be described.

As best illustrated in FIGS. 1 through 5, the tool with interchangeable heads 10 generally comprises a shaft 20 and interchangeable head members insertable into the shaft 20 including a first head member 40 with an auger head section 41 extending from a rod section 48, a second head member 60 with a mallet head section 61 extending from a rod section 65, and a third head member 70 with a chisel head section 71 extending from a rod section 76.

Preferably, the shaft 20 is elongate and cylindrical in shape. The interior surface 21 defines a hollow interior 25 with an opening 28 at the lower end 24 to permit receiving a head member 40,60,70 through the opening 28 into the hollow interior 25. The interior surface 21 includes a retaining means, such as, for example, a retaining pin groove 26 positioned towards the shaft lower end 24. For ease of use, the shaft 20 has a gripping portion 27 preferably surrounding the outer surface 22 near the upper end 23.

Figure 3:
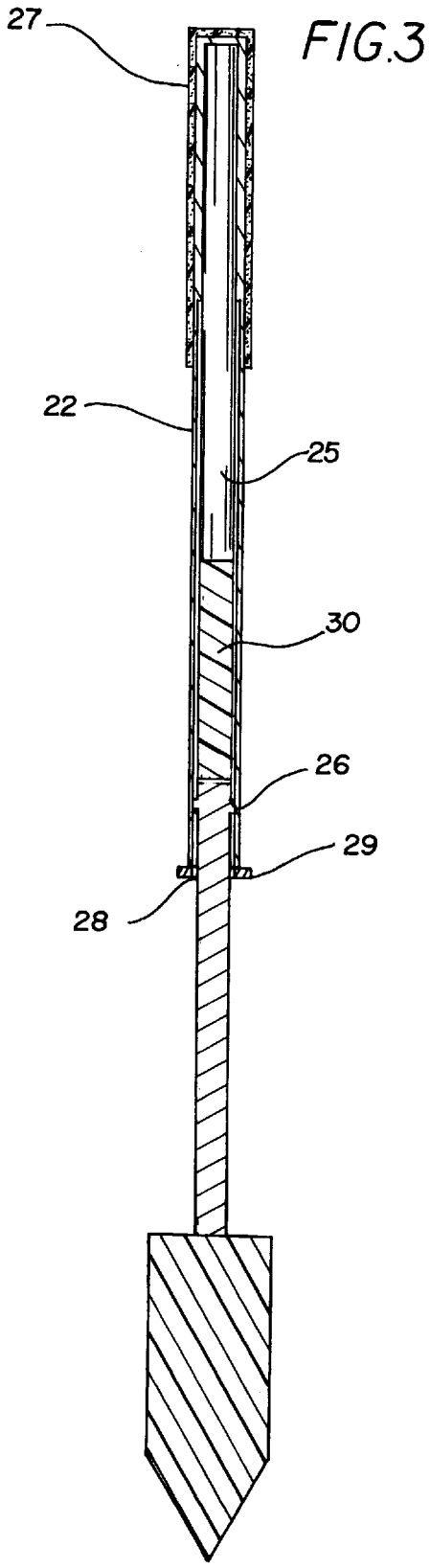
FIG. 3 is a cross sectional view of the present invention taken from line 3—3 on FIG. 1.

As shown in FIGS. 1 and 3, a bushing flange 29 extends radially from the outer surface 22 of the lower end 24. Ideally, the flange 29 surrounds the perimeter of the opening 28 thus limiting the size of the opening and forming a protective seal between the rod section 48,65,76 inserted through the opening 28.

A ram member 30 is disposed within the hollow interior 25 of the shaft 20. Preferably, the ram member 30 is coupled to the interior surface 21 proximal to the shaft lower end 24 providing additional weight to increase the magnitude of the driving force of the present invention on a surface. Ideally, the ram member 30 is welded to the interior surface 21 and positioned towards the lower end 24 of the shaft. This way, the ram member 30 may act as an abutment in contact with the end of the rod portion 48,65,76 to help force the head members 40,60,70 into a surface during use of the present invention. Ideally, the ram member 30 is similar in shape to the shaft interior surface 21. For example, if the shaft is elongate and cylindrical in shape, the ram member 30 is also elongate and cylindrical in shape.

Figure 2:
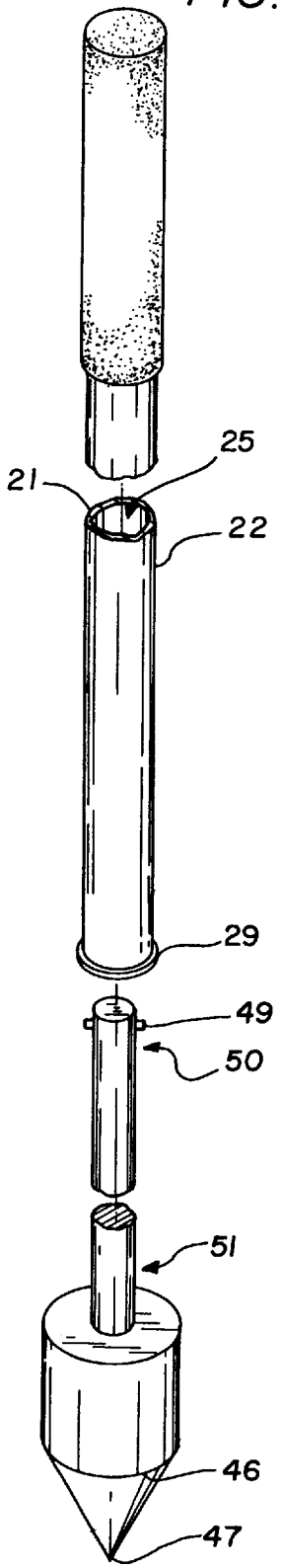
FIG. 2 is an exploded perspective view of the present invention.

The first head member 40, as shown in FIGS. 1,2 and 3, has an auger section 41 and a rod section 48. The auger head section 41 extends from the rod section lower end 51. The auger head section 41 includes a cylindrical portion 42 and a cone portion 45. The cylindrical portion 42 has an upper end 43 adjacent to the rod section lower end 51. The cone portion 45 is comprised of a base 46, which is adjacent to the cylindrical portion lower end 44 and a tip 47 that extends from the base. The first head member 40 is best suited for making holes in a surface, such as, for example holes for plants or installing fasteners. The tip 47 is formed to a point which best focuses the thrusting power from the user to a small, localized area thereby forcing the first head member 40 into the surface creating a hole.

Figure 4:
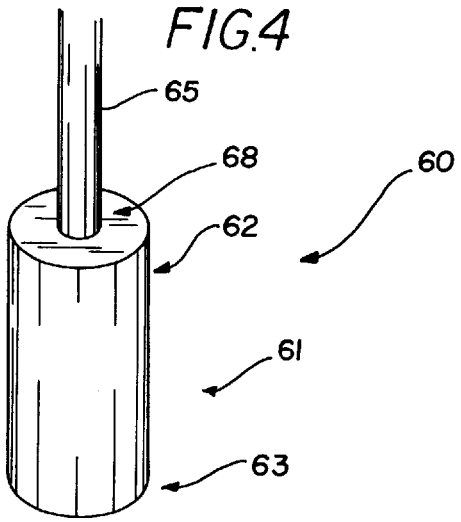
FIG. 4 is a partial perspective view of the mallet head section of the present invention.

The second head member 60, as shown in FIG. 4, has a mallet head section 61 and a rod section 65. The mallet head section 61 extends from the rod section lower end 51. The mallet head section 60 has an upper end 62 adjacent to the rod section lower end 68. The substantially planar surface of the mallet head section lower end 63 enables the second head member 60 to tap or flatten a surface.

Figure 5:
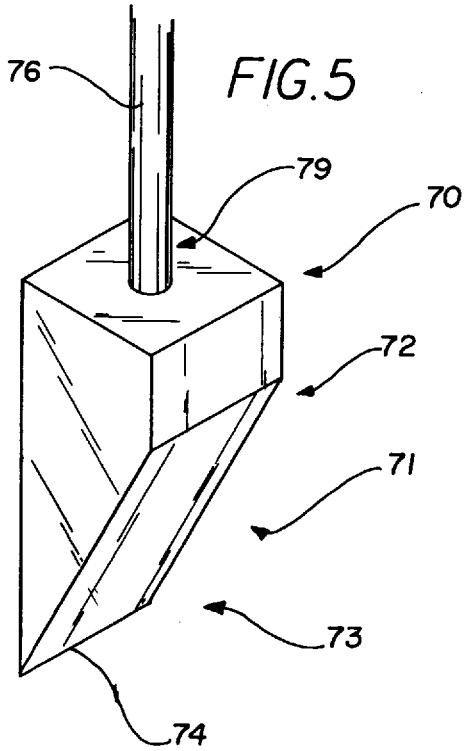
FIG. 5 is a partial perspective view of the chisel head section of the present invention.

The third head member 70, as shown in FIG. 5, has a chisel head section 71 and a rod section 76. The chisel head section 71 extends from the rod section lower end 79. The chisel head section 71 includes an upper end 72, a wedge portion 73, and a chisel edge 74. The chisel head section upper end 72 is adjacent to the rod section lower end 79 and the wedge portion 73 tapers therefrom into a chisel edge 74. The third head member is designed for chiseling away at a surface or the use of the chisel head section 71 as a lever to pry material or debris away from a surface. Alternatively, the third head member 70 may be utilized in the splitting of logs or other objects.

The rod section upper end of each corresponding head member 40,60,70 is insertable through the opening 28 of the shaft lower end 24 and into the hollow interior 25. Preferably, the rod section upper end of each corresponding head member 40,60,70 has some sort of retaining means to hold the rod sections 48,65,76 in place in the hollow interior 25 of the shaft 20.

Preferably, the rod sections 48,65,76 of each of the corresponding head members 40,60,70 have a retaining pin preferably positioned toward the rod section upper end. For example, as shown in FIGS. 2 and 3, the rod section 48 of the first head member 40 has a retaining pin 49 positioned toward the rod section upper end 50. The rod section upper end 50 is insertable through the opening 28 of the shaft lower end 24 and into the hollow interior 25 until the retaining pin 49 of the rod section upper end 50 engages the retaining pin groove 26 to hold the first head member 40 to the shaft 20. Ideally, the rod section upper end 50 is insertable into the hollow interior 25 until the upper end 50 is secured within the hollow interior 25 by a retaining means, such as the retaining pin 49 engaging the retaining pin groove 26, and the end of the upper end 50 abuts the ram member 30.

Preferably, the rod sections 48,65,76 of the first 40, second 60, and third 70 head member are substantially similar in shape to the interior surface 21 of the shaft 20. For example, if the interior surface 21 is elongate and cylindrical in shape, then similarly the rod section is elongate and cylindrical in shape.

In an optional embodiment, the retaining pin of the first 40, the second 60, and the third 60 head member is spring biased to engage the retaining pin groove 26 and securably attach the first head member 40 to the shaft 20.

The tool with interchangeable heads 10 enables the user to properly choose the head member that correctly fits a particular job. Depending on use, one of the head members is selected and attached to the shaft 20 of the tool with interchangeable heads 10. The rod section upper end is inserted into the opening 28 of the hollow interior 25. The retaining pin engages the retainer pin groove to secure the head member to the shaft 20. The user wields the tool with interchangeable heads 10 and rams the shaft 20 toward a surface thus driving the ram member 30 into the rod section thereby forcing the head member into a surface As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool system with interchangeable heads, comprising:

an elongate cylindrical shaft having an interior surface, an outer surface, an upper end, and a lower end, said interior surface defining a hollow interior, said interior surface having a retaining pin groove, said retaining pin groove being positioned towards said lower end, said outer surface having a gripping portion, said gripping portion being located towards said upper end of said shaft and having a length which is a fraction of that of the shaft, said lower end of said shaft having an opening into said hollow interior;

a bushing flange adapted for reducing a size of the opening of the cylindrical shaft;

an elongate cylindrical ram member being disposed within said hollow interior of said shaft, said ram member being coupled to said interior surface of said shaft, wherein the retaining pin groove extends from the opening of the cylindrical shaft to the ram member;

a first head member having an auger head section and a rod section, said auger head section having a cylindrical portion and a cone portion, said first head member rod section having an upper end and a lower end, said auger head section being extended from said lower end of said first head member rod section, said upper end of said first head member rod section adapted for being insertable through said opening of said shaft lower end into said shaft hollow interior;

a second head member having a mallet head section and a rod section, said second head member rod section having an upper end and a lower end, said mallet head section being extended from said lower end of said second head member rod section, said upper end of said second head member rod section adapted for being insertable through said opening of said shaft lower end into said shaft hollow interior; and a third head member having an chisel head section and a rod section, said chisel head section having a wedge portion, said third head member rod section having an upper end and a lower end, said chisel head section being extended from said lower end of said third head member rod section, said upper end of said third head member rod section adapted for being insertable through said opening of said shaft lower end into said shaft hollow interior;

wherein said first head member has a retaining pin, said retaining pin of said first head member rod section adapted for being engageable to said retaining pin groove of said shaft member interior surface to hold said first head member to said shaft member when said upper end of said first head member rod section is inserted into said shaft hollow interior;

wherein said second head member has a retaining pin, said retaining pin of said second head member rod section adapted for being engageable to said retaining pin groove of said shaft member interior surface when said upper end of said second head member rod section is inserted into said shaft hollow interior;

wherein said third head member has a retaining pin, said retaining pin of said third head member rod section adapted for being engageable to said retaining pin groove of said shaft member interior surface when said upper end of said third head member rod section is inserted into said shaft hollow interior;

wherein the retaining pins each include a pair of diametrically opposed protrusions that slide freely between the opening of the shaft and the ram member;

wherein the rod sections each has a length less than that of the cylindrical shaft.

2. The tool system with interchangeable heads of claim 1, wherein said cylindrical portion of said auger head section has an upper end and a lower end, wherein said cone portion of said auger head section has a base and a tip, said cone portion base being adjacent said lower end of said auger head section cylindrical portion, and said cone portion tip being extended from said lower end of said auger head section cylindrical portion.

3. The tool system with interchangeable heads of claim 2, wherein said upper end of said cylinder portion of said auger head section is positioned adjacent to said lower end of said first head member rod section.

4. The tool system with interchangeable heads of claim 1, wherein a second head member mallet head section has an upper end and a lower end, said upper end of said mallet head section being positioned adjacent to said lower end of said second head member rod section.

5. The tool system with interchangeable heads of claim 1, wherein said chisel head section has an upper end, said wedge portion being tapered to a chisel edge, said upper end of said chisel head section being positioned adjacent to said lower end of said third head member rod section.

6. The tool system with interchangeable heads of claim 1, wherein said mallet head section of said second head member is cylindrical in shape.

7. The tool system with interchangeable heads of claim 1, wherein said rod section of said second head member is cylindrical in shape.

8. A tool system with interchangeable heads, comprising:

an elongate cylindrical shaft having an interior surface, an outer surface, an upper end, and a lower end, said interior surface defining a hollow interior, said interior surface having a retaining pin groove, said retaining pin groove being positioned towards said lower end, said outer surface having a gripping portion, said gripping portion being located towards said upper end of said shaft and having a length which is a fraction of that of the cylindrical shaft, said lower end of said shaft having an opening into said hollow interior;

a bushing flange being adapted for reducing a size of the opening of the cylindrical shaft;

an elongate cylindrical ram member being disposed within said hollow interior of said shaft, said ram member being welded to said interior surface of said shaft, wherein the retaining pin groove extends from the opening of the cylindrical shaft to the ram member;

a first head member having an auger head section and an elongate cylindrical rod section, said auger head section having a cylindrical portion and a cone portion, wherein the cone portion has a length that is about ½ a length of the cylindrical portion, said cylindrical portion of said auger head section having an upper end and a lower end, said cone portion of said auger head section having a base and a tip, said cone portion base being adjacent said lower end of said auger head section cylindrical portion, said cone portion tip being extended from said lower end of said auger head section cylindrical portion, said first head member rod section having a retaining pin, an upper end and a lower end, said retaining pin of said first head member rod section being positioned towards said upper end of said first rod member rod section, said auger head section being extended from said lower end of said first head member rod section, said upper end of said cylinder portion of said auger head section being positioned adjacent to said lower end of said first head member rod section, said upper end of said first head member rod section adapted for being insertable through said opening of said shaft lower end into said shaft hollow interior, said retaining pin of said first head member rod section adapted for being engageable to said retaining pin groove of said shaft member interior surface to hold said first head member to said shaft member when said upper end of said first head member rod section is inserted into said shaft hollow interior;

a second head member having an cylindrical mallet head section and an elongate cylindrical rod section, said mallet head section having an upper end and a lower end, said second head member rod section having a retaining pin, an upper end and a lower end, said retaining pin of said second head member rod section being positioned towards said upper end of said first rod member rod section, said mallet head section being extended from said lower end of said second head member rod section, said upper end of said mallet head section being positioned adjacent to said lower end of said second head member rod section, said upper end of said second head member rod section adapted for being insertable through said opening of said shaft lower end into said shaft hollow interior, said retaining pin of said second head member rod section adapted for being engageable to said retaining pin groove of said shaft member interior surface to hold said first head member to said shaft member when said upper end of said second head member rod section is inserted into said shaft hollow interior; and a third head member having an chisel head section and an elongate cylindrical rod section, said chisel head section having an upper end with a rectangular configuration and a lower wedge portion, said lower wedge portion being tapered to a chisel edge with a side face thereof being coplanar relationship with a side face of the upper end, wherein the upper end has a length that is about ¼ a length of the lower wedge portion, said third head member rod section having a retaining pin, an upper end and a lower end, said retaining pin of said third head member rod section being positioned towards said upper end of said first rod member rod section, said chisel head section being extended from said lower end of said third head member rod section, said upper end of said chisel head section being positioned adjacent to said lower end of said third head member rod section, said upper end of said third head member rod section adapted for being insertable through said opening of said shaft lower end into said shaft hollow interior, said retaining pin of said third head member rod section adapted for being engageable to said retaining pin groove of said shaft member interior surface to hold said first head member to said shaft member when said upper end of said third head member rod section is inserted into said shaft hollow interior;

wherein the retaining pins each include a pair of diametrically opposed protrusions that slide freely between the opening of the cylindrical shaft and the ram member;

wherein the elongate cylindrical rod sections each has a length less than that of the cylindrical shaft.

* * * * *